United States Patent [19]

Plessis et al.

[11] Patent Number: 5,031,200

[45] Date of Patent: Jul. 9, 1991

[54] CATHODE FOR AN X-RAY TUBE AND A TUBE INCLUDING SUCH A CATHODE

[75] Inventors: André Plessis, Clamart; Catherine Thomas, Issy les Moulineaux; Paul Hery, Vanves, all of France

[73] Assignee: General Electric CGR SA, Issy Les Moulineaux, France

[21] Appl. No.: 558,447

[22] Filed: Jul. 27, 1990

[51] Int. Cl.[5] ..... H01J 35/06

[52] U.S. Cl. ..... 378/36; 378/137; 378/138

[58] Field of Search ..... 378/136, 119, 121, 134, 378/137, 138

[56] References Cited

U.S. PATENT DOCUMENTS 3,753,022 8/1973 Fraser, Jr. .

4,035,685 7/1977 Jacob ..... 378/136

4,373,144 2/1983 Franke ..... 378/136

FOREIGN PATENT DOCUMENTS 2267637 11/1975 France .

0165353 9/1984 Japan ..... 378/136

*Primary Examiner*—Edward P. Westin

*Assistant Examiner*—David P. Porta

*Attorney, Agent, or Firm*—Oblon, Spivak, McClelland, Maier & Neustadt

[57] ABSTRACT

The invention relates to X-ray tubes, and more particularly to cathodes for such tubes. The invention lies in the cathode, which includes an electron-emitting filament (26), being made in the form of a main body (10) of insulating material having metal electrodes (16 and 19) deposited thereon which are insulated from one another by the main body. The filament (26) and the electrodes (16 to 19) are connected to conductors (27, 21 to 23) which pass through the main body.

5 Claims, 1 Drawing Sheet

CATHODE FOR AN X-RAY TUBE AND A TUBE INCLUDING SUCH A CATHODE

Figure 1:
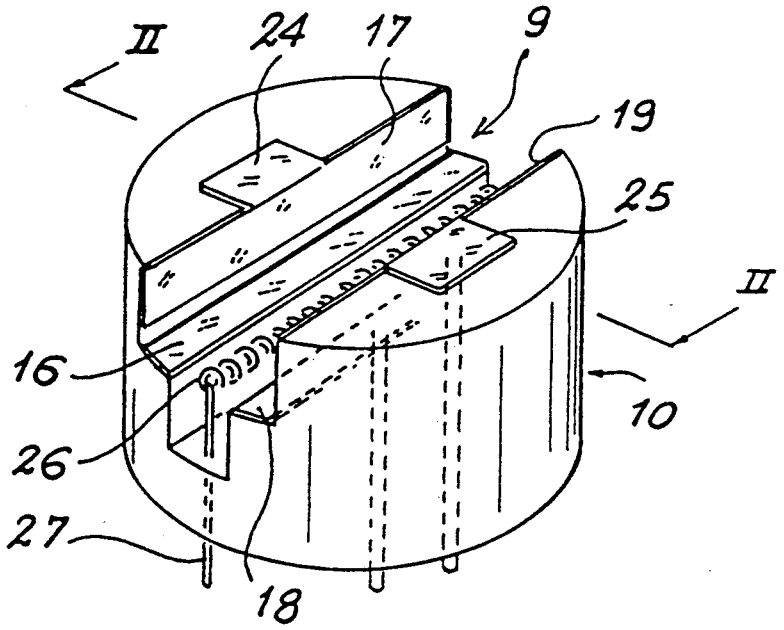

The invention relates to X-ray tubes, and more particularly to a cathode for an X-ray tube.

An X-ray tube comprises a vacuum enclosure containing a cathode constituted by a heated filament which emits electrons, and a concentrator device behind the filament to focus the emitted electrons towards an anode which is raised to a positive potential relative to the cathode. The point of impact of the beam of electrons on the anode constitutes a source of X-radiation in the form of a beam.

Development in X-ray imaging systems has lead to the use of X-ray tubes which are more and more complex in order to obtain the functions desired. It is therefore desirable to control the geometry of the electron beam which strikes the anode in order to obtain a point of impact of accurate dimensions and having an energy distribution which is as uniform as possible.

In some applications, it is necessary to obtain beams of X-rays at different energies and/or different angles of incidence; to this end, the cathode may have a plurality of electron-emitting filaments from which both the dimensions and the directions of electron flux must be controlled in order to obtain accurate points of impact of the electron beam on the anode.

In other applications it is necessary to modify the electron flow rate and possibly to switch it off completely by means of an electrode called the grid.

In order to provide the functions listed above, cathodes are geometrically complicated in shape and may comprise a plurality of metal electrodes which are mechanically separated and which are electrically insulated from one another.

In French patent number 2 538 948 filed Dec. 3, 1982 and entitled "Scanning X-Ray Tube", and also in French patent application number 89 03888 filed Mar. 24, 1989 and entitled "Scanning X-Ray Tube with Deflection Plates", the present Applicant describes the cathodes of X-ray tubes constituted by multiple electrodes which are difficult to manufacture and assemble and which are expensive.

An object of the present invention is thus to provide an X-ray tube cathode having multiple electrodes or otherwise, which is simple to manufacture and which is of reduced cost price.

The present invention provides an X-ray tube cathode including at least one electron-emitting filament, and characterized in that it comprises a main body made of an insulating material, metal electrodes which are disposed at determined locations of said main body and which are insulated from one another by virtue of the insulating material of the main body, and electrical conductors passing through said main body in order to feed said filament and to apply bias potentials to said metal electrodes.

The main body is made of a ceramic such as alumina, and the electrodes are made of molybedum, maganese, or tungsten, or an alloy thereof.

Figure 2:
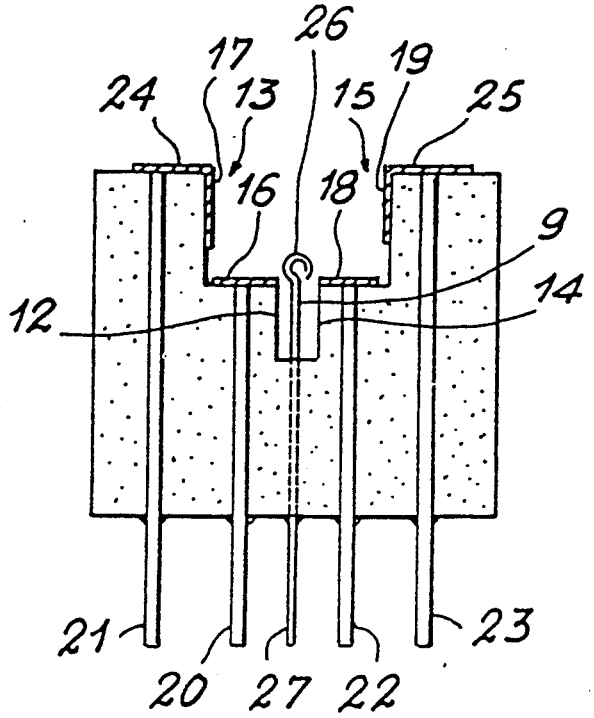

Other characteristics and advantages of the present invention appear from reading the following description of a particular embodiment, said description being made with reference to the accompanying drawing, in which:

FIG. 1 is an isometric perspective view of an embodiment of an X-ray tube cathode in accordance with the invention; and FIG. 2 is a section view on line II—II of FIG. 1.

In prior art cathodes, and in particular in those described in the above-mentioned French patent documents, there is always a metal supporting part which acts as the electrode that is taken to a negative potential in order to repel the electrons emitted by a heated filament, and that also serves to support said filament and other electrodes. These other electrodes are also made of metal and they need to be electrically isolated from said metal supporting part and from one another.

The invention provides a cathode in which the main body is made of an insulating material and on which the various electrodes are formed, with the insulation between various electrodes being obtained by the insulating material of the main body.

More precisely, the main body 10 is constituted by a block of alumina, for example, which is appropriately machined in order to obtain the shape shown in FIGS. 1 and 2, i.e. a circularly symmetrical cylinder having a diametricallyextending slot portion with stepped sides, one side having steps referenced 12 and 13 and the other side having steps referenced 14 and 15. The electrodes are obtained by metal deposits which are disposed at specified locations on the surface of the main body, in particular on the vertical faces and on the horizontal faces of the steps 12, 13, 14, and 15. For example, the entire area of the horizontal face of each of steps 12 and 14 is covered with a respective metal deposit referenced 16 or 18. In addition, the entire surface of the vertical face of each of steps 13 and 15 is covered with a metal deposit referenced 17 or 19 depending on the step in question.

These electrode-forming metal deposits 16 to 19 are biased to appropriate potentials by means of electrical conductors 20 to 23 passing through the main body 10 and emerging through the horizontal faces of the steps. For steps 12 and 14, the conductors 20 and 22 abut directly against the metal deposits 16 and 18 to which they are connected. For the steps 13 and 15, the conductors 21 and 23 are connected to the metal deposits 17 and 19 via metal tabs 24 and 25 which are disposed on the horizontal faces of the steps 13 and 15 and which are electrically connected to the metal deposits 17 and 19.

The, or each, cathode filament (reference 26) is disposed in conventional manner in the diametrically-extending slot so as to project beyond the level of metal deposits 16 and 18. The filament(s) is/are fed with electricity via conductors (referenced 27) passing through the main body 10.

The metal deposits 16 to 19 and the metal tabs 24 and 25 can be obtained in various different ways, in particular by thin film deposition on the alumina substrate of the main body, with said substrate being appropriately doped in order to allow the thin films to take hold. The doping substances may be metals such as molybdenum and manganese which are deposited as layers of liquid in the locations to be occupied by the electrodes, after which the assembly is heated to dope the surface layer of the body 10.

The material of the metal deposits must adhere to the alumina of the main body 10 and must withstand high temperatures. Suitable materials include, for example, molybdenum, manganese, tungsten, and alloys of these materials together or with other metals. The deposit may be obtained by vacuum evaporation, by subliminating the metals, by ion bombardment, or by plasma torch.

It is mentioned above that the main body 10 is made of alumina. The purity of the alumina needs to be about 95% to 97%, which is a commonly-available quality. The alumina could be replaced by a different ceramic.

The geometrical accuracy with which the electrodes are positioned in an X-ray tube cathode of the present invention is determined by the accuracy with which the main body is machined, and this can be both very high and reproducible. Compared with prior art cathodes, this avoids assembly operations in which accuracy depends on the dexterity of humans, and for which reproducibility is not constant over time nor from one person to another. The manufacturing cost is also lower than for prior art cathodes.

By using a one-piece main body 10, the effects of differential expansion between various parts are avoided, which effects are particularly troublesome with the separator electrodes of prior art cathodes. This means that deformations are very small.

Finally, since the main body 10 is insulating, the electrical conductors 27 for feeding the filament 26 and the conductors 21 to 23 for biasing the electrodes 16 to 19 pass through the said body without there being any covering around the conductors 21 to 23 and 27, thereby simplifying cathode manufacture and lowering cost price.

We claim:

1. An X-ray tube cathode including at least one electronemitting filament (26), and characterized in that it comprises a main body (10) made of an insulating material, metal electrodes (16 to 19) which are disposed at determined locations on said main body and which are insulated from one another by virtue of the insulating material of the main body, and electrical conductors (21 to 23 and 27) passing through said main body (10) in order to feed said filament (26) and to apply bias potentials to said metal electrodes (16 to 19).

2. A cathode according to claim 1, characterized in that the insulating material is a ceramic.

3. A cathode according to claim 1, characterized in that the insulating material is alumina.

4. A cathode according to claim 1, 2, or 3, characterized in that the insulating material of the main body is doped with metallic elements, at least at the locations of the metal electrodes, thereby enabling said electrodes to adhere to the body.

5. A cathode according to any preceding claim 4, characterized in that the metal of the metal electrodes (16 to 19) is selected from the group consisting of molybdenum; manganese; and tungsten.

* * * * *

UNITED STATES PATENT AND TRADEMARK OFFICE

CERTIFICATE OF CORRECTION

PATENT NO. : 5,031,200

DATED : July 9, 1991

INVENTOR(S) : Andre Plessis et al.

It is certified that error appears in the above-identified patent and that said Letters Patent is hereby corrected as shown below:

Title page

The foreign application priority data has been omitted, should be, --Aug. 7, 1989 [FR] France .....89 10611--.

Signed and Sealed this

Twenty-ninth Day of December, 1992

*Attest:*

DOUGLAS B. COMER

*Attesting Officer*

*Acting Commissioner of Patents and Trademarks*